US006550860B2

(12) United States Patent
Lombardi

(10) Patent No.: US 6,550,860 B2
(45) Date of Patent: Apr. 22, 2003

(54) WHEELED TELESCOPIC PERCUSSION INSTRUMENT CONTAINER

(75) Inventor: Donald G. Lombardi, Thousand Oaks, CA (US)

(73) Assignee: Drum Workshop, Inc., Oxnard, CA (US)

( * ) Notice: Subject to any disclaimer, the term of this patent is extended or adjusted under 35 U.S.C. 154(b) by 0 days.

(21) Appl. No.: 09/872,308

(22) Filed: Jun. 4, 2001

(65) Prior Publication Data

US 2002/0180247 A1 Dec. 5, 2002

(51) Int. Cl.[7] ..... A47C 31/00

(52) U.S. Cl. ..... 297/217.1; 280/47.26; 220/915.2; 297/188.09

(58) Field of Search ..... 297/217.1, 461, 297/219.1, 188.01, 188.08, 188.09, 188.06, 256.16, 188.2, 463.2, 188.12, 188.13, 411.36, 440.24; 280/47.17, 47.25, 47.4, 47.39, 47.26; 248/407, 188.5; 220/8, 915.1, 915.2, 4.03

(56) References Cited

U.S. PATENT DOCUMENTS

| | | | | | |
|---|---|---|---|---|---|
| 1,751,902 | A | | 3/1930 | Brown | |
| 2,827,004 | A | | 3/1958 | Luce et al. | |
| 2,912,785 | A | | 11/1959 | Nudell | |
| 3,114,468 | A | | 12/1963 | Quase | |
| 3,659,108 | A | | 4/1972 | Quase | |
| 4,441,734 | A | | 4/1984 | Schlissel | |
| 4,460,188 | A | * | 7/1984 | Maloof | 280/30 |
| 4,624,341 | A | * | 11/1986 | Lee | 182/15 |
| 4,852,757 | A | * | 8/1989 | Gold | 220/4 A |
| 5,170,516 | A | * | 12/1992 | Davison | 4/484 |
| 5,481,988 | A | | 1/1996 | Dess | |
| D371,185 | S | * | 6/1996 | Mullins | D22/136 |
| 5,586,805 | A | * | 12/1996 | Rinehart | 297/188.09 |
| 5,605,242 | A | * | 2/1997 | Hwang | 220/8 |
| 5,715,962 | A | | 2/1998 | McDonnell | |
| 5,758,886 | A | * | 6/1998 | Mayer | 280/47.26 |
| 5,899,467 | A | | 5/1999 | Henkel | |
| 6,296,313 | B1 | * | 10/2001 | Wu | 297/411.36 X |
| 6,375,200 | B1 | * | 4/2002 | Harter | 280/30 |

* cited by examiner

*Primary Examiner*—Peter R. Brown
*Assistant Examiner*—Stephen Vu
(74) *Attorney, Agent, or Firm*—William W. Haefliger

(57) ABSTRACT

A transportable adjustable seat assembly comprising, upper, lower and intermediate sleeves having telescopic interconnections, a seat on the upper sleeve transporting structure including wheels carried by the lower sleeve and adjustable locking elements associated with at least two of the sleeves for locking said two sleeves in selected positions of vertical height adjustment.

16 Claims, 6 Drawing Sheets

WHEELED TELESCOPIC PERCUSSION INSTRUMENT CONTAINER

BACKGROUND OF THE INVENTION

This invention relates generally to seat devices which are transportable and adjustable, as for use by musicians and others; and more particularly concerning a seat device which defines an interior storage area, for example to carry musical equipments or music sheets.

There is a need for devices of the above type, since musicians constantly move between performance locations, and have a need to carry their equipments and music, including seats which they have become accustomed to.

SUMMARY OF THE INVENTION

It is a major object of the invention to provide an improved device of the above type, which has many highly advantageous features. Basically, the preferred device includes:

a) upper, lower and intermediate sleeves having telescopic interconnections, b) a seat on the upper sleeve, c) transporting structure including wheels carried by the lower sleeve.

d) and adjustable locking elements associated with at least two of the sleeves for locking the two sleeves in selected positions for vertical height adjustment.

The referenced elements are preferably located proximate side walls of at least two sleeves, and are adjustable at the interior of the structure.

It is another object to provide one of the locking elements to define at least one vertical series of slots carried by a side wall of one of the intermediate and lower sleeves. Another of such elements constitutes at least one support carried by the side wall of the other of said intermediate and lower sleeves and located to be selectively received in each of the different slots. The slots may be defined by at least one plate attached to the side wall of one of the intermediate and lower sleeves, with the plate facing to the interior of said sleeve assembly. The support may comprise a threaded member projecting sidewardly through the walls of the intermediate and lower sleeves, and through the plate.

Yet another object is to provide three of such vertical series of slots, and there are at least three of the supports respectively associated with said at least three series of slots. Such slots may advantageously define dwell regions for reception of at least one support, to block twisting displacement of the supports out of the slots without relative vertical movement of the intermediate and lower sleeves.

A further object is to provide at least one trunnion on the lower sleeve, the transporting structure including at least one wheel carrying axle carried by that trunnion. As will be seen, there are typically two trunnions carrying the axle, and a handle projects downwardly between the trunnions for connection to the axle, and also projecting upwardly at a side of assembly. At least one strap is typically carried by the assembly to wrap the adjacent handle and the assembly, for retaining the handle to the assembly.

A further object is to provide multiple sleeve retention straps spaced about the assembly and acting to hold the sleeves against relative vertical separation in a selected position of vertical height adjustment. The internal supports are then enabled to be held in selected dwell regions by the external retention straps acting on the sleeve assembly.

An additional object is to provide a transporting structure that includes an upright handle having operative connection to the lower sleeve, at a lower elevation, and also releasably connected to at least one of the sleeves at an upper elevation.

These and other objects and advantages of the invention, as well as the details of an illustrative embodiment, will be more fully understood from the following specification and drawings, in which:

DRAWING DESCRIPTION

DETAILED DESCRIPTION

Figure 2:
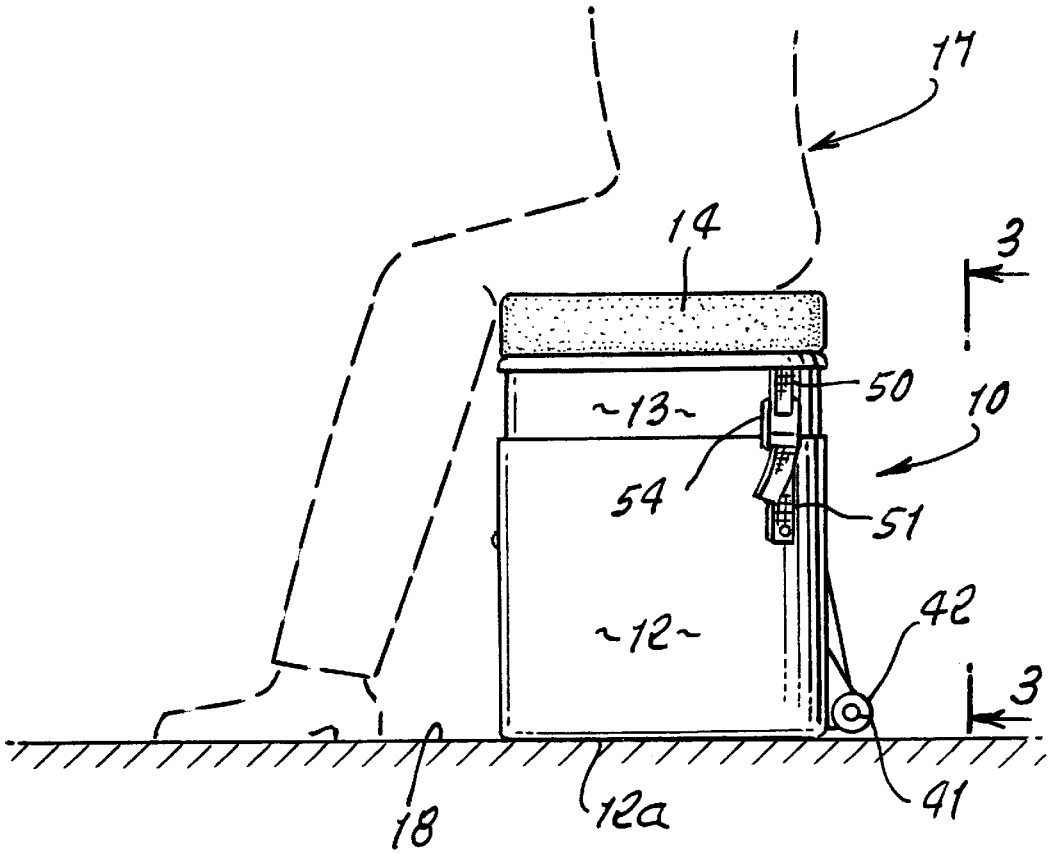
FIG. 2 is a side view of the seat assembly in use as a seat, as for a drummer.

In the drawings, the transportable, adjustable seat assembly 10 includes upper, lower and intermediate cylindrical, thin-walled sleeves 11, 12 and 13 respectively, and which have telescopic sliding interconnections. A seat such as cushion 14 is attached at 15 to a top cover 11*a* associated or integral with top sleeve 11. A turned-down peripheral flange 11*b* on the upper sleeve receives and seats on the upper, turned-down edge portion 13*a* of sleeve 13. Upper sleeve 11 and the seat 14 are removable off the intermediate sleeve, to enable access to the interior 16 of the assembly. Musical equipment and music folios may be stored in that interior, for safe transportation from one performance location to another performance location. A musician sits on seat 14, during a performance, as seen at 17 in FIG. 2. At that time, the bottom wall 12*a* of lower sleeve 12 typically rests on a floor surface 18, providing a wide, very stable support, as the musician shifts about on seat 14.

Figure 4:
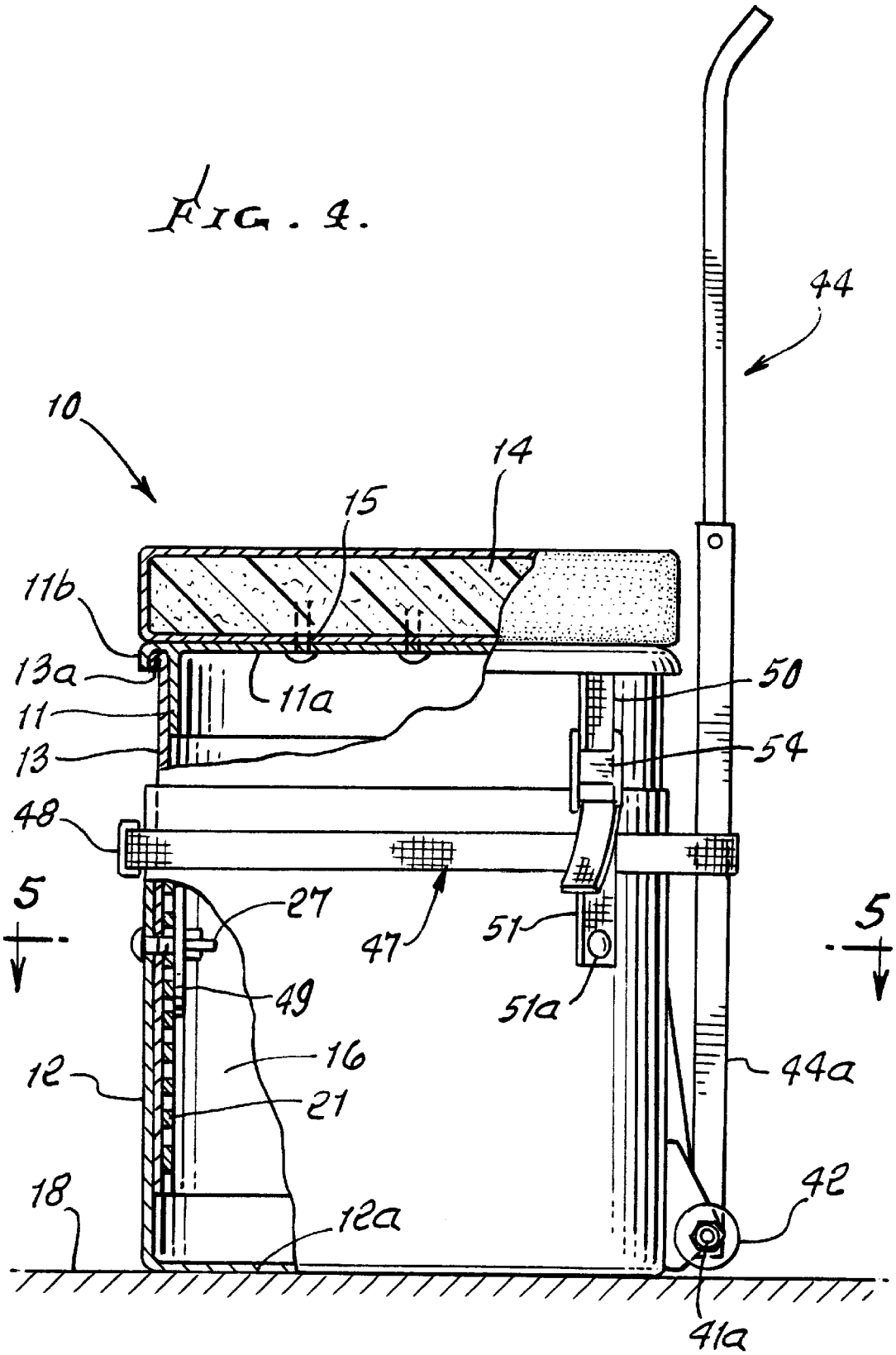
FIG. 4 is an elevation taken on lines 4—4 of FIG. 3.
Figure 5:
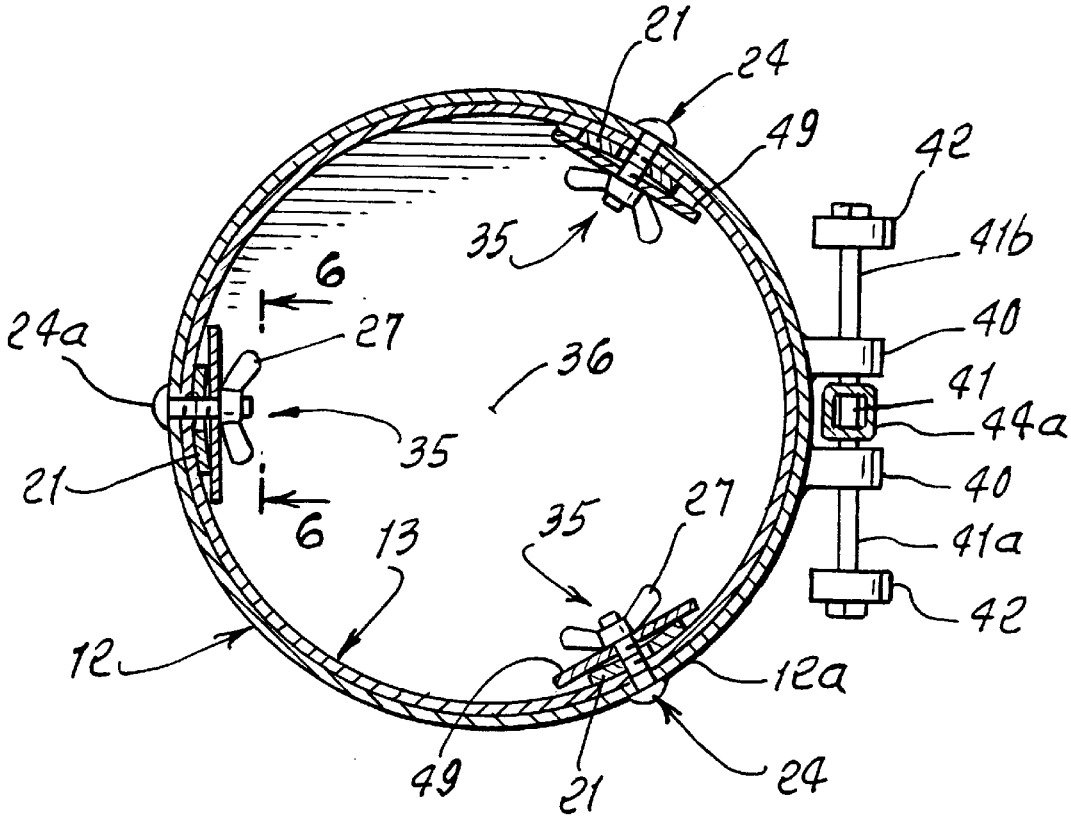
FIG. 5 is a horizontal section taken on lines 5—5 of FIG. 4.
Figure 6:
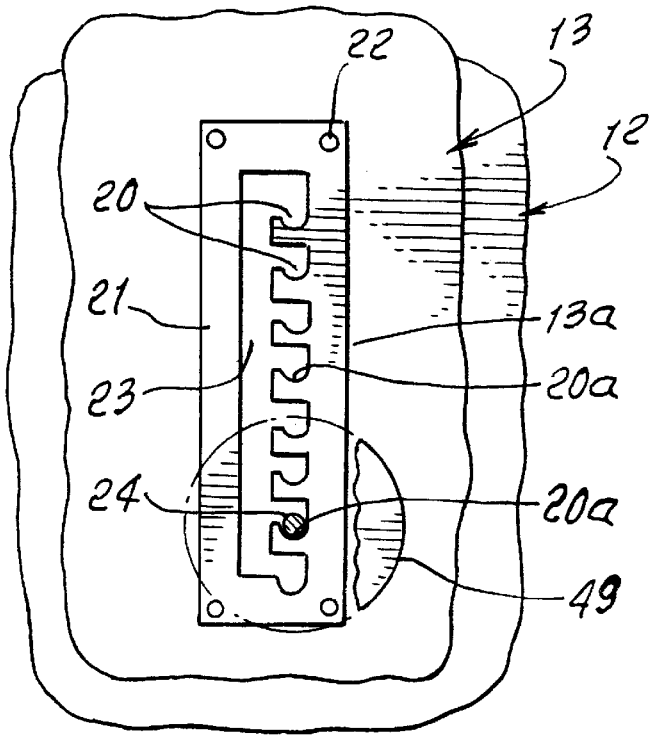
FIG. 6 is an enlarged fragmentary view taken in elevation on lines 6—6 of FIG. 5.
Figure 7:
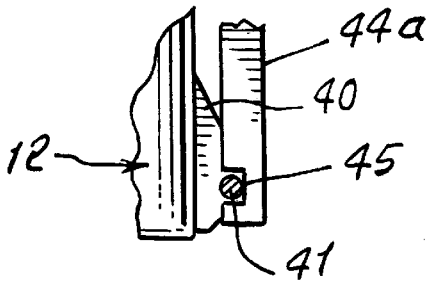
FIG. 7 is a fragmentary section taken on lines 7—7 of FIG. 3.
Figure 8:
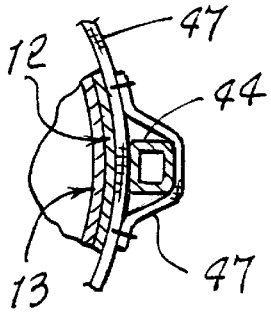
FIG. 8 is a horizontal section taken on lines 8—8 of FIG. 3.

Adjustable locking elements are provided in association with at least two of the sleeves, as for example sleeves 12 and 13, for locking them in selected positions of assembly height adjustment, to suit the position and seating of the musician 17. Such elements are preferably proximate or adjacent to thin side walls defined by the sleeves 11 and 13. One of such elements defines at least one vertical series of slots carried by a side wall of the intermediate or lower sleeve. In the example, as seen in FIG. 6, slots 20 are defined or formed by a plate 21 attached at 22 to the side wall portion 13*a* of the intermediate sleeve 13, as seen in FIGS. 4–6, the slots extending sidewardly from a vertically elongated slot 23 in the plate. Plate 21 faces and is exposed to the interior of the assembly. A spacer 49 is located between the plate 21 wing nut 27.

Another of the adjustable locking elements constitutes at least one support member, as for example, fastener 24, carried by the side wall portion, at 12*a*, of the other (sleeve 12) of the two sleeves 12 and 13, and located to be selectively received in different ones of the slots 20, for height adjustment. In the example, fastener 24 is threaded, and projects sidewardly through the sleeve walls and through the plate. A rounded head member 24*a* engages the outer side wall of sleeve 12 and presents a smooth outer surface. The threaded inner end member receives a wing nut 27, that can be loosened to enable sleeve height adjustment, or tightened to hold the sleeve in adjusted position, with the fastener 24 in a downwardly captivated position in a slot 20. The slot has a lowermost portion 20*a* that provides a downwardly gravitational position for the fastener 24, to resist its inadvertent sideward movement such as twisting displacement.

Preferably, multiple locking elements, which are alike, are provided, as at 120° interval locations 35 spaced about assembly axis 36, as seen in FIG. 5, thereby providing multiple locking or sleeve orienting positions, both vertically and horizontally, about axis 36, for maximum balance and height adjusted assembly integrity. When a height adjustment change is desired, the wing nuts are loosened, and the sleeve 13 is lowered slightly relative to sleeve 12 to free the members 24 upwardly from dwell locations at 20*a*; and the sleeve 13 is then twisted to locate the members 24 in the vertical slots 23 from which slots 20 sidewardly extend. This enables vertical displacement of sleeve 13 relative to sleeve 12, and reverse twisting location of the members 24 in other selected slots 20 and dwells 20*a*, thereby achieving stable height adjustment. The wing nuts are then again tightened. The use of three members 24 is to achieve positive, non-rocking, stake support.

Figure 1:
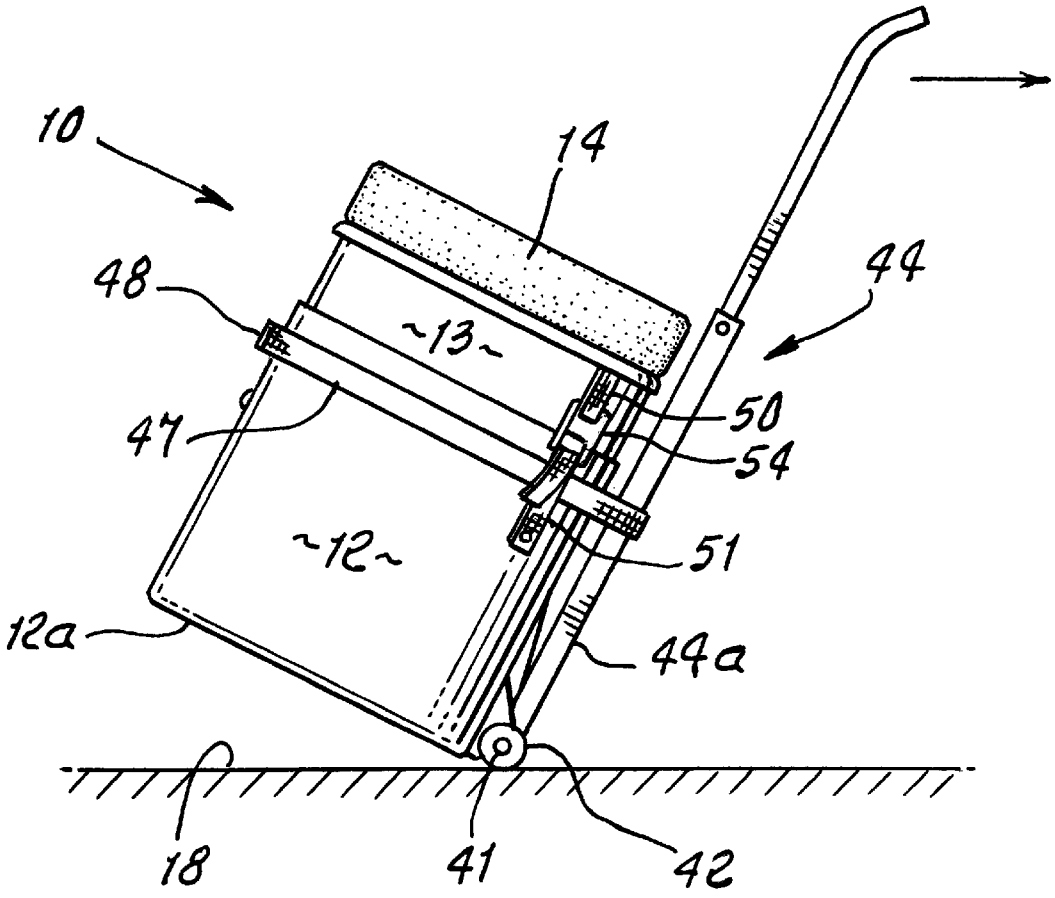
FIG. 1 is a side elevation showing an adjustable seat assembly incorporating the invention, and of the preferred type.
Figure 3:
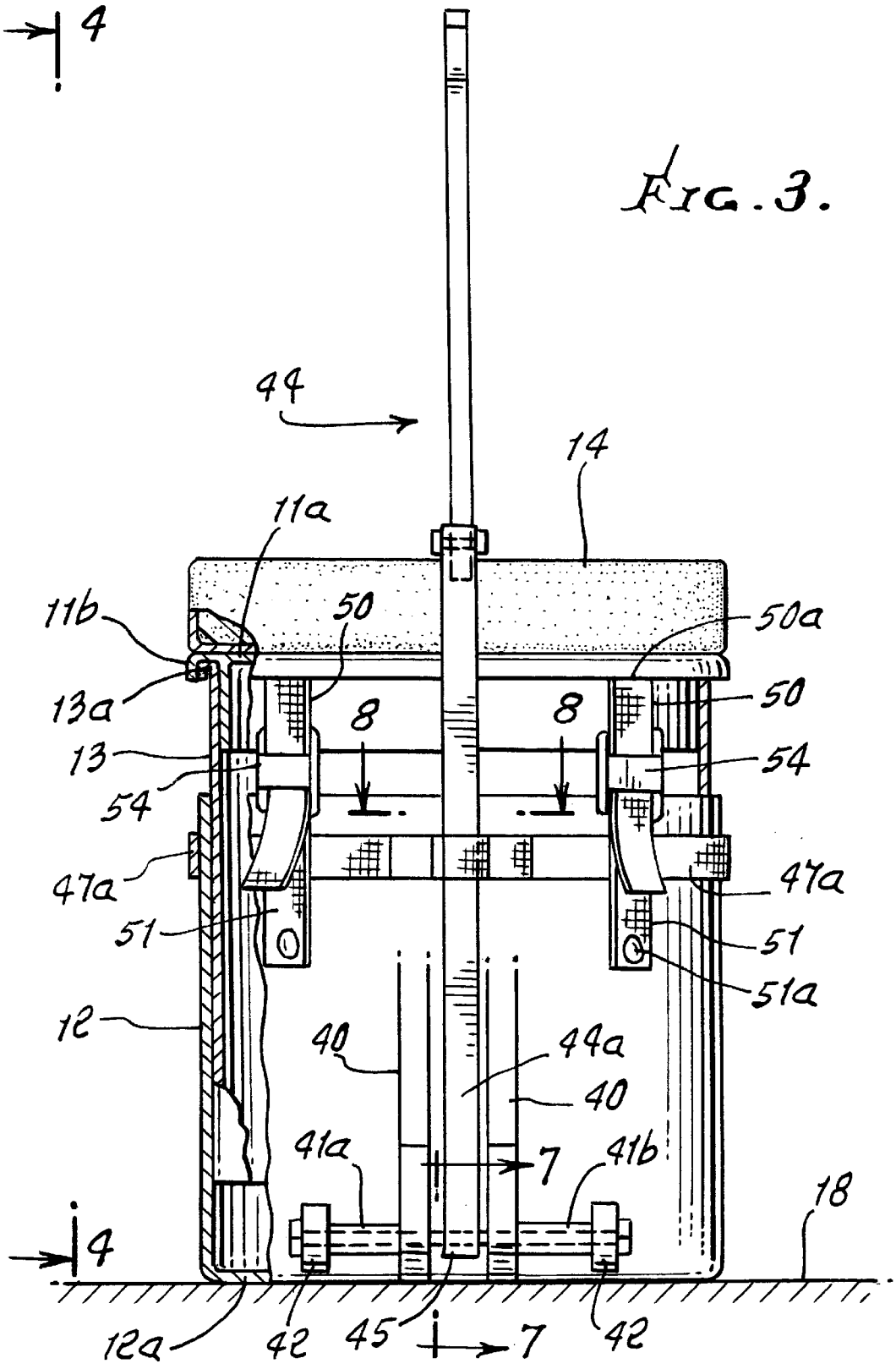
FIG. 3 is an enlarged elevation taken on lines 3—3 of FIG. 1, and partly broken away to show interior construction.

At least one trunnion, and preferably two trunnions 40 are carried by lower sleeve 12, to support a transverse axle 41 extending beyond the trunnions at 41*a* and 41*b*, for in turn supporting wheels 42. The latter are located above the bottom level of the sleeve 12 transverse to bottom 12*a*, to enable flat, stable positioning of the assembly on floor surface 18. A handle 44 has a lower portion 44*a* projecting downwardly between the trunnions for pivotal connection at 45 to the axle, mid-way between the wheels. The handle projects upwardly at a side of the assembly as seen in FIGS. 1, 3 and 4. At least one strap is carried by said assembly to wrap adjacent to the handle and the assembly for retaining the handle to the assembly. See for example, strap 47 or strap sections 47*a*, buckled together at 48, to hold the handle in an upright position, enabling tilting and wheeling of the assembly, as shown in FIG. 1.

Also provided are multiple retainer upper and lower straps, as at 50 and 51, spaced about the assembly at three or four locations, and acting to hold the three sleeves in inter-connected telescopic condition. Upper straps 50 are shown as connected at 50*a* to the turned down rim portion 11*b* of the upper sleeve 11 top; and lower straps 51 are shown as attached at 51*a* to the lower sleeve 12. Buckles 54 hold the straps 50 and 51 together, and may be loosened to enable seat removal, and access to the interior of the assembly to store or retrieve musical equipment.

The handle can then released and lowered to the floor, as during a musical performances.

I claim:

1. A transportable adjustable seat assembly comprising:

a) upper, lowers and intermediate sleeves having interconnecting relationships, wherein at least two of the sleeves have telescopic interconnection, b) a seat on the assembly, c) a transporting structure including wheels carried by the lower sleeve, d) adjustable locking elements associated with at least two of the sleeves for locking said two sleeves in selected positions for vertical height adjustment, e) said intermediate and lower sleeves each having side walls near said elements, wherein the sidewalls have recesses to receive said elements, f) one of said elements defining at least one vertical series of slots carried by a side wall of one of the intermediate and lower sleeves, and another of said elements has at least one support carried by the side wall of the other of said intermediate and lower sleeves and located to be selectively received in said different slots, g) at least one strap carried by said assembly to wrap adjacently to the handle and said lower sleeve for retaining the handle to the assembly, and h) multiple groups of sleeve retention straps spaced about the assembly and acting to hold the sleeves against relative vertical separation in a selected position of vertical height adjustment, wherein said multiple groups of sleeve retention straps extend adjacent to said upper, intermediate, and lower sleeves.

2. The assembly of claim 1 wherein one of said elements includes at least one plate attached to said side wall of one of the intermediate and lower sleeves, said at least one plate facing and exposed to the interior-of said sleeve assembly.

3. The assembly of claim 2 wherein each of said supports is a threaded member projecting sidewardly through said side walls of the intermediate and lower sleeves and through the plate.

4. The assembly of claim 1 wherein three of said vertical series of slots are respectively associated with at least three of said supports.

5. The assembly of claim 1 wherein said slots define dwell regions for receiving at least one of said supports, to block twisting displacement of the supports out of the slots without relative vertical movement of the intermediate and lower sleeves.

6. The assembly of claim 5 including multiple sleeve retention straps spaced about the assembly and acting to hold the sleeves against relative vertical separation in a selected position of vertical height adjustment, said supports held in selected dwell regions by said retention straps acting on the sleeve assembly.

7. The assembly of claim 1 including at least one trunnion carried by the lower sleeve, said transporting structure including at least one wheel carrying axle carried by said at least one trunnion.

8. The assembly of claim 7 wherein at least two of said trunnions carrying said axle, and a handle projecting downwardly between said trunnions for connecting to said axle, and also projecting upwardly at a side of said assembly.

9. The assembly of claim 8 including at least one strap carried by said assembly to wrap the handle and the assembly for retaining the handle to the assembly.

10. The assembly of claim 9 including multiple sleeve retention straps spaced about the assembly and acting to hold the sleeves against relative vertical separation in a selected position of vertical height adjustment.

11. The assembly of claim 1 wherein said transporting structure includes an upright handle having operative connection to the lower sleeve at a lower elevation, and also releasably connected to at least one of the sleeves at an upper elevation, enabling said handle to be released and lowered during a musical performance.

12. The assembly of claim 1 wherein said seat includes a cushion.

13. A transportable adjustable seat assembly comprising:

a) multiple sleeves including upper and lower sleeves having interconnecting relationships b) a seat on the assembly, c) transporting structure carried by the lower sleeve, d) adjustable locking elements associated with at least two of the sleeves for locking said two sleeves in selected positions for vertical assembly height adjustment, said elements located proximate side edges defined by two of the sleeves, one said element defining slots in a sleeve, and another of said elements defining supports carried by another of said sleeves for selective reception in the slots, e) said seat carried on the assembly to be upwardly movable relative to said upper sleeve and an intermediate sleeve for access to a hollow interior as defined by the assembly, f) and including multiple groups of sleeve retention straps spaced about the assembly and acting to hold the sleeves against relative vertical separation in a selected position of vertical height adjustment, each of said groups of said multiple sleeve retention straps extending adjacent said upper, intermediate and lower sleeves.

14. The assembly of claim 13 wherein said elements are proximate side walls defined by said upper and intermediate sleeves.

15. The assembly of claim 14 wherein said transporting structure includes an upright handle having operative connection to said lower sleeve at a lower elevation, and also releasably connected to at least one of the sleeves at an upper elevation, enabling said handle to be released and lowered while in use said seat can be vertically raised from a position above said lower elevation and above said upper elevation.

16. The combination of claim 13 wherein said upper sleeve of said multiple sleeves carries said seat, for vertical movement relative to other said sleeves.

* * * * *